US005468545A

United States Patent [19]

Fleming et al.

[11] Patent Number: 5,468,545

[45] Date of Patent: Nov. 21, 1995

[54] LONG WEAR LIFE FLAME-RETARDANT COTTON BLEND FABRICS

[76] Inventors: George R. Fleming, 2709 Dobbs Dr., Phenix City, Ala. 36867; James R. Green, 22 Robin Dr., Hockessin, Del. 19707

[21] Appl. No.: 315,443

[22] Filed: Sep. 30, 1994

[51] Int. Cl.[6] ..... B32B 7/00

[52] U.S. Cl. ..... 428/259; 428/225; 428/257; 428/258; 428/920; 8/115.7

[58] Field of Search ..... 428/225, 257, 428/258, 259, 288, 920, 921, 260, 276, 277; 8/115.7

[56] References Cited

U.S. PATENT DOCUMENTS 4,732,789 3/1988 Hauser et al. ..... 427/393.3

*Primary Examiner*—James J. Bell
*Attorney, Agent, or Firm*—Terry M. Gernstein

[57] ABSTRACT

Flame-retardant treated cotton/thermoplastic fiber blend fabrics have been discovered which have extended wear life and retain their flame-retardant treatment for the life of the garment.

6 Claims, No Drawings

LONG WEAR LIFE FLAME-RETARDANT COTTON BLEND FABRICS

DESCRIPTION

This invention relates to cotton/thermoplastic fiber blend fabrics which have long wear life and retain their flame resistance for the life of the garment because after 24 hours emersion in boiling water they retain an unusually uniform distribution among the cotton fibers of tetrakis (hydroxymethyl) phosphonium compounds (hereafter described as THP compounds) as shown by the fact that they will not burn more than 15 mm (6") at fabric edges even though they may contain as little as 2% phosphorus.

BACKGROUND

The high fatigue resistance of thermoplastic fibers can increase the wear life of garments made primarily of cotton and it is therefore highly desireable to include them in flame resistant cotton fabrics as is described in U.S. Pat. No. 4,920,000. However, because the mechanical durability is significantly enhanced and the fabric contains flammable thermoplastic fibers, garments can lose their flame resistance before they wear out.

Conventional single step flame-retardant processes used for cotton fabrics are not commercially viable for cotton/thermoplastic fabrics because the high level of flame retardant chemicals (5%) normally needed to compensate for the presence of the thermoplastic fibers are deposited preferentially on the surface of yarns creating a crust which causes the fabric to be stiff and uncomfortable.

Conventional single step processes for cotton/synthetic fiber blends also do not produce fabrics with flame-retardant treatment which lasts the life of the garment because the flame retardant readily washes off.

Commercially viable flame resistant cotton/thermoplastic fabrics have been produced through a two treatment process wherein the cotton and the thermoplastic fibers are treated separately using two different flame retardants. For example in U.S. Pat. No. 4,732,789 two different chemical treatments are needed to achieve flame resistance in cotton blends containing thermoplastic fibers.

SUMMARY OF THE INVENTION

This invention provides cotton/thermoplastic fiber blend fabrics with comfortable flexibility and extended wear life wherein only the cotton is flame-retardant. Fabrics of the invention have a uniform distribution of durable flame retardant such that they do not burn along exposed edges even after 24 hours exposure to boiling water containing detergent and contain as little as 2.0% phosphorus in the fabric. Fabrics which meet these criteria have been shown to retain their flame resistance for at least 100 industrial launderings which is as long as the garments last when worn.

In the process described for the first time herein, the cotton/thermoplastic blend fabrics are made highly flame resistant and wash durable by treating fabrics at high bath concentrations and wet pickup of tetrakis (hydroxymethyl) phosphonium compounds (hereafter described as THP compounds) and reducing moisture to a range of 8 to 12% prior to ammoniation. Within an extremely narrow range of bath concentrations and moisture level it has been discovered that it is possible to uniformly treat cotton/thermoplastic fiber blend fabrics with THP compounds in a single pass at commercial speeds such that the flame retardant is prevented from migrating to the surface of cotton blend yarns and is thoroughly cured so that it is retained for the life of the garment.

Fabrics of this invention have uniformly treated cotton fibers within the yarn bundle and consist of fabrics containing 5 to 30% thermoplastic fibers, 50 to 95% flame resistant cotton, 0 to 30% thermoset fibers and contain at least 2.0% phosphorus in the fabric after 24 hours exposure to a boiling water, detergent solution.

DETAILED DESCRIPTION OF THE INVENTION

The staple fibers used herein are textile fibers having a linear density suitable for wearing apparel, i.e., less than 10 decitex per fiber, preferably less than 5 decitex per fiber. Still more preferred are fibers that have a linear density of 1 to 3 decitex per fiber and length from 1.9 to 6.3 cm (0.75 to 2.5 in). Crimped fibers are particularly good for textile aesthetics and processibility.

It is important to maintain the proper content of the three fiber types to achieve the desired results. If the fabric contains more than 30% thermoplastic fibers, the protection provided even by distributing the flame retardant uniformly will be overcome, causing the fabric to burn. Too little thermoplastic fiber will result in no improvement in wear life compared with 100% cotton fabrics.

Too much thermoset fiber will cause a loss of desirable cotton aesthetics. Too little cotton will result in a loss of flame resistance since the other fibers are not affected by the THP flame-retardant treatment and moisture will be removed too quickly from the fabrics to control the process at commercial speeds as is explained below.

The introduction of thermoplastic fibers into cotton fabrics makes it very difficult to flame-retardant treat the fabrics. In addition to the flammability of the thermoplastic fibers, they are also hydrophobic and can therefore make it difficult for flame-retardant treatments to penetrate yarn bundles and when penetration does occur, the aqueous flame retardant solutions migrate to the surface of yarn bundles more rapidly than with 100% cotton. The rapid drying of cotton/thermoplastic fiber blends is well known. The differences in drying rates and fabric wet out are the primary reasons why processes which will produce satisfactory 100% cotton fabrics will not produce cotton/thermoplastic fiber blend fabrics where the treatment lasts the life of the garment.

The product described herein is made by uniform treatment of cotton/thermoplastic fabrics with flame retardant chemicals. The method described for the first time herein is to dip fabrics into a bath with a concentration of flame retardant chemicals such that 60 to 80% by weight of fabric of solution is sufficient to apply 3.0% to 4.0% phosphorus to the fabric. After the fabric is drawn through the aqueous flame retardant bath, wet pickup is controlled to 60 to 80% by weight of fabric with pressure from a pad roll. The fabric is dried to a low moisture level, 8 to 12%, and then run through an ammoniation chamber.

At bath concentrations sufficient to apply 3.0% to 4% phosphorus by weight of fabric at 60 to 80% wet pickup in a single pass to cotton synthetic fiber blends, flame retardant can quickly solidify on the fibers on the outside of the blend yarns to form a sheath which prevents the ammonia from penetrating the blend yarn bundle. While the cotton fibers on the inside of yarns contain a high level of phosphorus because of the high bath concentration and solution penetration caused by pressure from the pad roll, lack of sufficient ammonia for polymerization causes the flame retardant on the cotton in the center of the yarns to wash off after laundering. Use of lower chemical concentrations in the bath adequate to apply less than 3.0% phosphorus in the bath allows more uniform polymerization of the flame retardant throughout the yarn bundle but does not provide sufficient flame retardant to prevent burning after extensive laundering.

By using bath concentrations sufficient to apply 3.0 to 4.0% phosphorus at 60 to 80% wet pickup and squeezing the fabrics after the bath to obtain 60 to 80% wet pickup and then drying the fabrics to between 8 and 12% moisture level on weight of fabric before ammoniation, the rate of migration of the flame retardant solution is slowed enough to allow the ammonia gas to penetrate the yarn bundle causing flame retardant within the yarn interior to stay in place and polymerize fully such that high levels of flame retardant are retained on the interior cotton fibers even after extensive laundering. The higher the amount of thermoplastic and thermoset fibers in the fabric the lower the bath concentration and moisture must be in order to allow the ammonia to penetrate. Below 50% cotton content the bath concentration must be so low to allow ammonia penetration that insufficient flame retardant is applied to last the life of the garment.

If the phosphorus is uniformly distributed in the yarn bundles, as little as 2.0% phosphorus needs to be retained on fabric boiled 24 hrs to prevent the fabric from burning at fabric edges even though the fabric contains flammable thermoplastics and oxygen is more readily available at the cut edges.

Thermoplastic fibers with a melting point above 200 deg C. such as 66 and 6 nylon, polyethylene terephthalate and other polyesters, must be used to prevent loss of fabric durability well below the degradation temperature of cotton.

While this invention relates primarily to flame-retardant treated cotton/thermoplastic fiber blends, synthetic thermoset fibers may also be added in limited quantities to provide other benefits such as increased heat resistance or to modify the appearance or hand. Many synthetic thermoset fibers are suitable such as rayon, poly(p-phenylene terephthalamide), polybenzimidazol and poly(m-phenylene isophthalamide), polyacrylinitrile and other acrylics, polyimides and novoloids such as that made under the trade name Kynol.

Treatment with adequate levels of flame retardant can be done in a single application and cure process by impregnating the fabrics with an aqueous solution containing a precondensate of urea ($NH_2CONH_2$) and a tetrakis (hydroxymethyl) phosphonium salt, referred to as THP, as THPC when the salt the chloride and THPS when the salt is the sulfate $[(HOCH_2)_4P^+]_2SO_4$—; the oxalate and phophate salts are also satisfactory. THP salt/urea precondensate is applied to the fabric within a specific range of concentration and wet pickup and dried to a carefully controlled range of moisture level. It is then reacted on the fabric with ammonia gas, under controlled conditions to form an ammoniated flame retardant which is in turn oxidized, usually with hydrogen peroxide, to form a flame retardant polymer within the cotton fibers.

At least two satisfactory commercial products are available for single application and cure flame-retardant treatment. One is "Pyroset" TPO, a THPS/urea precondensate of tetrakis (hydroxymethly) phosphonium sulfate and urea available from Freedom Chemical Company, Charlotte, N.C. The other is THPC/urea prepolymer condensate of tetrakis (hydroxymethly) phosphonium chloride and urea licensed by Albright and Wilson, Richmond, Va. and is known as the "Proban" process.

In all cases the concentration of the aqueous flame retardant bath, the percent fabric pickup, fabric moisture level and ammonia concentration are chosen to apply at least 3.0% and less than 4.0% phosphorus by weight of fabric in the wet state prior to curing. Flame retardant concentration, wet pickup and moisture level of the fabric going into the ammoniator are adjusted within the their respective ranges described above such that after 5 washes and 24 hours in boiling water, the fabric retains at least 2 and no more than 3% phosphorus and does not burn at cut edges. If the fabric retains more than 3% phosphorus after the 24 hour boil it will lose flexibility and become stiff.

The Proban process is described in detail in the following U.S. Pat. Nos. 4,078,101; 4,145,463; 4,311,855 and 4,494,951, all to Albright and Wilson. The information in these references is helpful to explain the chemistry of the THP salt/urea precondensation process. However, these disclosures do not reveal how to make cotton/thermoplastic fiber blend fabrics which retain their flame-retardant treatment for the life of the garment.

During preparation of the fabrics of the invention durable press resins may be applied to the fabric. Many other conventional fabric treatments may also be carried out on the fabrics such as mercerization, application of dyes, hand builders and softeners, sanforization and framing. Fabrics may be woven or knitted.

MEASUREMENTS

VERTICAL FLAMMABILITY

Federal test method 5903.1 is intended for use in determining the resistance of cloth to flame and glow propagation and tendency to char. A rectangular cloth test specimen (76×305 mm) with the long direction parallel to the warp or fill direction is placed in a holder and suspended vertically in a cabinet with the lower end ¾ inch (19 mm) above the top of a gas burner. The flame is held in the center of the fabric and no edges are exposed to the flame because they are enclosed in the holder.

A synthetic gas mixture consisting of hydrogen and methane is supplied to the burner. After the specimen is mounted in a cabinet the burner flame is applied vertically at the middle of the fabric for 12 seconds. Char length is measured as the distance in inches from the exposed end of the specimen to the end of a lengthwise tear through the charred area caused by lifting a prescribed weight. Five specimens from each sample are usually measured and the results averaged. A burn length of less than 15 cm (6") is required to pass this test.

EDGE BURNING TEST

Fabrics are tested for Edge Burn after 5 home launderings at 140 deg F. with detergent alternated with drying in a drier after each wash, followed by 24 hrs in boiling water containing a small amount of detergent as a wetting agent. Fabrics are then rinsed by using one home laundry cycle at 140 deg F. without detergent and dried in a dryer.

While it is important that edges not serve as points of ignition for protective garments exposed to flames, it has also been found that fabrics which do not burn at the edges following the edge burning procedure also will pass the vertical flame test after 100 industrial launderings which is equivalent to the life of the garment. The edge burn test is much faster and cheaper than laundering garments 100 times and measuring vertical flame. Correlation between the two tests are given in the examples below.

Edge burning is determined with a modified version of the Vertical Flammability Test described above. Three samples are cut in the warp or wale direction only and ironed flat if they are wrinkled. In a modification of Federal Test Method 5903.1, the specimen is mounted in the holder with one edge placed 35 mm into the gap between the interior edges of the holder with the tip of the flame impinging 10 mm from the exposed fabric edge for 6 seconds. The flame is then moved to 20 mm from the exposed specimen edge and held for another 3 seconds or until the flame reaches the top of the specimen, whichever occurs first. The height to which the flame rises is measured by determining the maximum length of fabric blackened to at least a 6 mm width.

If the flame retardant is not uniform or of an inadequate level or there is too much thermoplastic fiber in the yarn bundles, the ready access of oxygen to the fibers at the exposed fabric edge will cause the fabric to burn along the edge at least 15 mm (6") as evidenced by observing the height to which the flame rises. Fabrics of this invention have adequate amounts of flame retardant distributed uniformly such that they will burn less than 15 mm (6") along the edges even after 5 washes and 24 hrs in boiling water with detergent.

FLEX ABRASION RESISTANCE

Durability of fabrics was tested after one home wash using the American Society for Testing Materials test D 3885-80 (flexing and abrasion method) in the warp direction only. Cycles required to cause fabrics to break was measured.

PHOSPHORUS RETENTION WITHIN YARN BUNDLES

The ability of fabrics to retain phosphorus inside yarn bundles was determined by measuring the relative amount of phosphorus on two cotton fibers on the outside of a yarn bundle in a test fabric compared with two cotton fibers near the center using wavelength dispersion X-ray analysis, a common analytical method described on pp 292–304 of the book "Scanning Electron Microscopy and X-Ray Analysis", Joseph I. Goldstein, et.al, 1981, Plenum Publishing Corp, 233 Spring St., New York, N.Y., 10013. Samples from fabrics to be tested were embedded in epoxy resin in the warp direction and cut with a microtome blade to expose warp ends. After suitable preparation an individual warp yarn was selected and individual cotton fibers within the selected warp yarns were scanned to determine relative phosphorus content. The ratio of the average phosphorus counts for the cotton fibers on the outside of the yarns to those on the inside is defined as the Phosphorus Ratio. When fabrics are tested after 5 washes and 24 hours in boiling water, it is a measure of the ability of fabrics to retain the flame retardant which has been exposed to the least amount of ammonia such as occurs at yarn centers but it is a more expensive and difficult test than the Edge Burning Test which also is a measure of flame retardant uniformity. Fabrics of this invention have a Phosphorus Ratio usually below 5 and most often of 1, which indicates that the flame retardant is cured just as well on the inside of yarn bundles as on the outside.

EXAMPLE 1

Woven fabric was made as a 4×1 sateen having in the warp 15 wt % of polyhexamethylene adipamide (6,6 nylon) fibers having a linear density of 2.77 dtex (2.5 dpf) and a cut length of 3.8 cm (1.5 in) (available as T-420 nylon from Dupont) and 85% cotton. The fill was 100% cotton and the fabric had a nylon content of 8% and cotton content was 92%. Basis weight was 270 gm/m$^2$.

The fabric was padded to a wet pick up of 63% by weight of fabric of the flame retardant solution containing Pyroset TPO from Freedom Chemical Co as shown in Table 1 which was sufficient to apply 3.5% phosphorus by weight of fabric. The fabric was dried to a moisture level of 12% as measured with a Mahlo meter and then put through a chamber at 46 mpm (50 ypm) and exposed to ammonia gas flowing at 3.3 cu m/min. (118 cfm). The fabric was oxidized with a hydrogen peroxide/sodium silicate solution. The fabric was rinsed and dried. After 5 washes and 24 hr boiling the fabric burned less than 15 mm (6") on it's edge, contained 2.1% phosphorus and had a Phosphorus Ratio of 1. After 100 industrial launderings the fabric passed the vertical flame test.

Comparative Examples A–C, not of this invention and described in Table 2 were made by using the same fabric as described in to Example 1 at 36 mpm (40 ypm) processing speed, and varying bath concentration. All ingrediants in the bath formula shown in Table 1 except water were varied in proportion to the TPO level shown in Table 2 and water was then added to obtain the balance per 1000 liters of mix. Moisture level was raised above 12% in all cases. In the edge burn test Comparative Examples A–C failed by burning at least 15 mm (6") and all retained only 1.9% phosphorus after 5 washs and 24 hours in boiling water. Comparative Example C failed the vertical flame test after 100 industrial launderings. Comparative Example D, not of this invention and also treated as described in Table 2 was made of 100% cotton warp and fill with construction similar to that of Example 1 except that it had a basis weight of 237 gm/m$^2$. Sample D retained 2.7% phosphorus after 24 hr boil and passed the Edge Burn test even though it was processed at high bath concentration and moisture level like Comparative Example C, which failed. This illustrates the significant difference between processing 100% cotton fabrics vs. cotton/thermoplastic blends.

EXAMPLE 2

The procedure of Example 1 was used except that the nylon content was increased to 25% by weight in the warp and fabric weight was increased to 288 gm/m$^2$. The fabric had a nylon content of 13% and a cotton content of 87%. Bath concentration was reduced to 499 kgm TPO and moisture reduced to 11% to compensate for the higher nylon content. Wet pickup after the pad roll was increased to 70% which resulted in 3.5% phosphorus pickup like Example 1. After 5 washes and 24 hr boil the fabric retained 2.1% phosphorus, passed the edge burn test and had a Phosphorus Ratio of 1. Comparative Example E shown in Table 3 was made using the same fabric as for Example 2 except that the bath concentration and moisture level were the same as for Example 1 and wet pickup was 70%. After 5 washes and 24 hr boil the fabric retained only 1.9% phosphorus, failed the edge burn test and had a Phosphorus Ratio of 100 which illustrates the sensitivity of the process to the cotton and thermoplastic fiber content.

The processes used for the Examples 1,2 are described in summary form in Table 3 for comparison. Comparative Example F was made like Example 1 but from 100% cotton. Table 4 shows how adding a thermoplastic like nylon significantly increases the abrasion resistance compared with 100% cotton by comparing Examples 1,2,F. Table 5 shows how the Edge Burn test compares with the Vertical Flame test after 100 industrial launderings.

TABLE 1

1000 LITER BATH FORMULA FOR EXAMPLE 1

| | KGM |
|---|---|
| PYROSET TPO | 549 |
| SODIUM ACETATE | 33 |
| SOFTENER | 33 |
| COMPATIBILIZER | 1.1 |
| ALCOHOL | 8.1 |
| WATER | 539 |

TABLE 2

EXAMPLES OF THE INVENTION

| | KGM TPO 1000 LITERS | PHOSPHORUS % WET PICK UP | PHOSPHORUS % 24 HR BOIL | RATIO | MOIST. % | EDGE BURN |
|---|---|---|---|---|---|---|
| Ex 1 | 549 | 3.5 | 2.1 | 1 | 12 | PASS |
| Ex. 2 | 499 | 3.5 | 2.1 | 1 | 11 | PASS |

TABLE 3

COMPARATIVE EXAMPLES NOT OF THE INVENTION

| | KGM TPO 1000 LITERS | PHOSPHORUS % WET PICK UP | PHOSPHORUS % 24 HR BOIL | RAT-IO | MOIST. % | EDGE BURN |
|---|---|---|---|---|---|---|
| Ex. A | 499 | 3.1 | 1.9 | 100 | 13 | FAIL |
| Ex. B | 598 | 3.8 | 1.9 | 20 | 13 | FAIL |
| Ex. C | 598 | 3.8 | 1.9 | — | 14.5 | FAIL |
| Ex. D 100% cotton | 598 | 3.8 | 2.6 | 1 | 13 | PASS |
| Ex. E | 549 | 3.9 | 1.9 | 100 | 12 | FAIL |

TABLE 4

BENEFIT OF THERMOPLASTIC TO ABRASION RESISTANCE

| SAMPLE | COMPOSITION | ASTM D-3885-80 CYCLES TO FAILURE |
|---|---|---|
| Comparative | 100% cotton warp and fill | 3400 |

TABLE 4-continued

BENEFIT OF THERMOPLASTIC TO ABRASION RESISTANCE

| SAMPLE | COMPOSITION | ASTM D-3885-80 CYCLES TO FAILURE |
|---|---|---|
| Example 1 | 85/15% cotton/nylon warp 100% cotton fill | 4500 |
| Example 2 | 75/25% cotton/nylon warp 100% cotton fill | 10800 |

TABLE 5

EDGE BURN VS. VERTICAL FLAME

| SAMPLE | EDGE BURN | VERTICAL FLAME AFTER 100 INDUSTRIAL LAUNDERINGS WARP × FILL | |
|---|---|---|---|
| Example 1 | PASS | 3 × 3" | PASS |
| Comparative Example C | FAIL | 12 × 12" | FAIL |

We claim:

1. Wash resistant durable fabrics, including woven fabrics comprising: 50 to 95% cotton fibers; 5–30% non-flame-retardant thermoplastic fibers in which warp yarns for woven fabrics are comprised of 50 to 95% cotton and 5 to 30% non-flame-retardant thermoplastic fibers; said fibers being uniformly treated with a durable flame retardant of a prepolymer of urea and tetrakis (hydroxymethyl) phosphonium salt which has been applied, ammoniated and oxidized in a manner such that after exposure to five washes and twenty-four hours emersion in boiling water, the cotton fabrics burn less than 15 mm (6") at cut edges and retain at least 2.0% and no more than 3.0% phosphorus by weight of fabric.

2. The wash resistant durable fabrics defined in claim 1 further including 5 to 30% thermoset fibers in said warp yarns.

3. The wash resistant durable fabrics defined in claim 1 wherein said thermoplastic fibers are only in said warp yarns.

4. The wash resistant durable fabrics defined in claim 1 in which said thermoplastic fibers are nylon.

5. The wash resistant durable fabrics defined in claim 1 in which said thermoplastic fibers are polyester.

6. The wash resistant durable fabrics defined in claim 2 in which said thermoset fibers are poly (p-phenylene terephthalamide).

* * * * *

UNITED STATES PATENT AND TRADEMARK OFFICE

CERTIFICATE OF CORRECTION

PATENT NO. : 5,468,545

DATED : November 21, 1995

INVENTOR(S) : George R. Fleming, et al

It is certified that error appears in the above-indentified patent and that said Letters Patent is hereby corrected as shown below:

Column 1, line 12, change "15 mm" to --15 cm--
Column 5, lines 21 and 24, change "15 mm" to --15 cm--
Column 6, lines 21 and 35, change "15 mm" to --15 cm--
Column 8, line 42, change "15 mm" to --15 cm--.

Signed and Sealed this

Seventeenth Day of September, 1996

*Attest:*

Bruce Lehman

BRUCE LEHMAN

*Attesting Officer*

*Commissioner of Patents and Trademarks*

US005468545C1

(12) EX PARTE REEXAMINATION CERTIFICATE (5812th)

United States Patent

Fleming et al.

(10) Number: US 5,468,545 C1

(45) Certificate Issued: Jul. 17, 2007

(54) LONG WEAR LIFE FLAME-RETARDANT COTTON BLEND FABRICS

(75) Inventors: George R. Fleming, Phenix City, AL (US); James R. Green, Hockessin, DE (US)

(73) Assignees: MF & H Textiles, Butler, GA (US); Itex, Inc., Aurora, CO (US)

Reexamination Request:
No. 90/007,560, May 27, 2005

Reexamination Certificate for:

| | |
|---|---|
| Patent No.: | **5,468,545** |
| Issued: | **Nov. 21, 1995** |
| Appl. No.: | **08/315,443** |
| Filed: | **Sep. 30, 1994** |

Certificate of Correction issued Sep. 17, 1996.

(51) Int. Cl.

| | |
|---|---|
| ***D06M 13/00*** | (2006.01) |
| ***D06M 13/285*** | (2006.01) |
| ***D06M 15/37*** | (2006.01) |
| ***D06M 15/667*** | (2006.01) |
| ***D06M 15/431*** | (2006.01) |

(52) U.S. Cl. ..... 442/143; 442/214; 428/920; 8/115.7

(58) Field of Classification Search ..... None
See application file for complete search history.

(56) References Cited

U.S. PATENT DOCUMENTS

| | | | |
|---|---|---|---|
| 4,078,101 | A | 3/1978 | Cole |
| 4,123,573 | A | 10/1978 | Wagner |
| 4,123,574 | A | 10/1978 | Wagner |
| 4,145,463 | A | 3/1979 | Cole |
| 4,154,878 | A | 5/1979 | Baitinger et al. |
| 4,156,747 | A | 5/1979 | Wagner |
| 4,311,855 | A | 1/1982 | Cole et al. |
| 4,494,951 | A | 1/1985 | Cole et al. |
| 4,732,789 | A | 3/1988 | Hauser et al. |
| 4,812,144 | A | 3/1989 | Hansen |
| 4,909,805 | A | 3/1990 | Smith |
| 4,920,000 | A | 4/1990 | Green |
| 5,468,545 | A | 11/1995 | Fleming et al. |
| 5,480,458 | A | 1/1996 | Fleming et al. |
| 5,571,288 | A | 11/1996 | Zakikhani et al. |

FOREIGN PATENT DOCUMENTS

| | | |
|---|---|---|
| CA | 2 048 402 | 2/1992 |

*Primary Examiner*—Stephen Stein

(57) ABSTRACT

Flame-retardant treated cotton/thermoplastic fiber blend fabrics have been discovered which have extended wear life and retain their flame-retardant treatment for the life of the garment.

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–6 is confirmed.

* * * * *

US005468545C2

(12) EX PARTE REEXAMINATION CERTIFICATE (6129th)

United States Patent

Fleming et al.

(10) Number: US 5,468,545 C2

(45) Certificate Issued: Feb. 19, 2008

(54) LONG WEAR LIFE FLAME-RETARDANT COTTON BLEND FABRICS

(75) Inventors: George R. Fleming, Phenix City, AL (US); James R. Green, Hockessin, DE (US)

(73) Assignee: Itex, Inc., Aurora, CO (US)

Reexamination Request:
No. 90/008,435, Jan. 16, 2007

Reexamination Certificate for:

| | |
|---|---|
| Patent No.: | **5,468,545** |
| Issued: | **Nov. 21, 1995** |
| Appl. No.: | **08/315,443** |
| Filed: | **Sep. 30, 1994** |

Reexamination Certificate C1 5,468,545 issued Jul. 17, 2007

Certificate of Correction issued Sep. 17, 1996.

(51) Int. Cl.

| | |
|---|---|
| ***D06M 13/00*** | (2006.01) |
| ***D06M 13/285*** | (2006.01) |
| ***D06M 15/37*** | (2006.01) |
| ***D06M 15/667*** | (2006.01) |
| ***D06M 15/431*** | (2006.01) |

(52) U.S. Cl. ..... 442/143; 428/920; 442/214; 8/115.7

(58) Field of Classification Search ..... None
See application file for complete search history.

(56) References Cited

U.S. PATENT DOCUMENTS

| | | | |
|---|---|---|---|
| 4,909,805 | A | 3/1990 | Smith |
| 4,920,000 | A | 4/1990 | Green |

*Primary Examiner*—Stephen Stein

(57) ABSTRACT

Flame-retardant treated cotton/thermoplastic fiber blend fabrics have been discovered which have extended wear life and retain their flame-retardant treatment for the life of the garment.

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–6 is confirmed.

* * * * *